US012781612B2

(12) United States Patent
Huang et al.

(10) Patent No.: US 12,781,612 B2
(45) Date of Patent: Nov. 3, 2026

(54) SYSTEMS AND METHODS FOR DETERMINING ANGULAR AND TRANSLATIONAL ACCELERATION AT A DRILL BIT

(71) Applicant: Baker Hughes Oilfield Operations LLC, Houston, TX (US)

(72) Inventors: Xu Huang, Spring, TX (US); Armin Kueck, The Woodlands, TX (US); Eugene Stolboushkin, Houston, TX (US); John Abhishek Raj Bomidi, Peral River, NY (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/811,503

(22) Filed: Aug. 21, 2024

(65) Prior Publication Data

US 2026/0055694 A1 Feb. 26, 2026

(51) Int. Cl.
*E21B 44/00* (2006.01)
*E21B 47/013* (2012.01)
*E21B 47/024* (2006.01)

(52) U.S. Cl.
CPC ..... *E21B 44/00* (2013.01); *E21B 47/013* (2020.05); *E21B 47/024* (2013.01)

(58) Field of Classification Search
CPC ..... E21B 44/00; E21B 47/013; E21B 47/024
See application file for complete search history.

(56) References Cited

U.S. PATENT DOCUMENTS

| | | | | |
|---|---|---|---|---|
| 6,518,756 | B1 * | 2/2003 | Morys | E21B 47/00 324/303 |
| 8,275,544 | B1 | 9/2012 | Wells et al. | |
| 10,378,286 | B2 * | 8/2019 | Hough | E21B 47/024 |
| 2009/0194332 | A1 * | 8/2009 | Pastusek | E21B 47/017 702/9 |
| 2015/0101865 | A1 * | 4/2015 | Mauldin | E21B 44/00 175/40 |
| 2015/0330210 | A1 * | 11/2015 | Lozinsky | E21B 47/024 73/152.46 |
| 2018/0223646 | A1 * | 8/2018 | Zhang | E21B 47/022 |
| 2022/0034223 | A1 * | 2/2022 | Evans | E21B 45/00 |
| 2022/0121791 | A1 * | 4/2022 | Chen | E21B 10/43 |
| 2022/0187489 | A1 * | 6/2022 | Yang | E21B 44/00 |
| 2022/0195862 | A1 * | 6/2022 | Chen | E21B 47/18 |

OTHER PUBLICATIONS

International Search Report for Application No. PCT/US2025/041607 dated Dec. 8, 2025, 3 pages.
International Written Opinion for Application No. PCT/US2025/041607 dated Dec. 8, 2025, 5 pages.

* cited by examiner

*Primary Examiner* — Matthew R Buck
(74) *Attorney, Agent, or Firm* — TraskBritt

(57) ABSTRACT

A method of deriving angular acceleration of a drill bit includes receiving data from one or more sensors of a sensor module installed on a drill bit. The one or more sensors include at least one accelerometer and at least one rotational motion sensor. The data received from the one or more sensors may be filtered. Angular velocity and angular acceleration are calculated from acceleration data received from the at least one accelerometer in response to a determination that the at least one rotational motion sensor is not providing accurate data.

20 Claims, 5 Drawing Sheets

SYSTEMS AND METHODS FOR DETERMINING ANGULAR AND TRANSLATIONAL ACCELERATION AT A DRILL BIT

TECHNICAL FIELD

This disclosure relates generally to detecting and deriving physical characteristics of a dynamic system. More specifically, this disclosure relates to obtaining rotational acceleration, rotational velocity, and translational acceleration of drill bits such as earth-boring drill bits used to drill subterranean formations.

BACKGROUND

Wellbores for oil wells are usually drilled with a drill string. The drill string includes a tubular member having a drilling assembly that includes a drill bit at its lower end. The drilling assembly typically includes devices and sensors that provide information relating to a variety of parameters relating to the drilling operations, behavior of the drilling assembly, and parameters relating to the formations penetrated by the wellbore.

In some instances, a drill bit of the drilling assembly may comprise sensors to measure parameters experienced at or near the drill bit. Such parameters measured by the sensors may include the acceleration of the drill bit including angular acceleration and translational acceleration. Other parameters may include angular velocity of the drill bit. The sensors may comprise one or more accelerometers, gyroscopes, and the like that are installed onto one or more portions of the drill string. In some instances, data from one or more of the sensors may become faulty or may be lost for various reasons. Accordingly, sensor data and post processing of sensor data should be robust to obtain desired information about the drill bit even when faulty data is received or when data is missing.

BRIEF SUMMARY

In one aspect, a method of deriving angular acceleration of a drill bit is provided. The method includes receiving data from one or more sensors of a sensor module installed on a drill bit. The one or more sensors include at least one accelerometer and at least one rotational motion sensor. The data received from the one or more sensors may be filtered. Angular velocity and angular acceleration at the drill bit are calculated from data received from the at least one accelerometer in response to a determination that the at least one rotational motion sensor is not providing accurate data.

In one aspect, a method of deriving translational acceleration of a drill bit is provided. The method includes receiving data from one or more sensors of a sensor module installed on a drill bit. The one or more sensors include at least one accelerometer and at least one rotational motion sensor. The data received from the one or more sensors may be filtered. Translational acceleration at the drill bit is derived from accelerometer data from the at least one accelerometer. The method may also include determining that the accelerometer data from the at least one accelerometer includes clipped data where a magnitude of an acceleration is greater than a measurement capacity of the at least one accelerometer. The accelerometer data is filtered to remove the clipped data when it is determined the accelerometer data from the at least one accelerometer includes the clipped data.

In one aspect, a method for deriving translational acceleration of a drill bit from at least one accelerometer is provided. The method includes receiving accelerometer data from the at least one accelerometer and determining the accelerometer data includes clipped data indicating that an acceleration along a measurement axis of the at least one accelerometer exceeds a measurement capacity of the accelerometer. The clipped data may be filtered from the accelerometer data based on frequencies of torsional vibrations of the drill bit. Translation acceleration is determined based on the filtered accelerometer data.

BRIEF DESCRIPTION OF THE DRAWINGS

For a detailed understanding of the disclosure, reference should be made to the following detailed description, taken in conjunction with the accompanying drawings, in which like elements have generally been designated with like numerals.

DETAILED DESCRIPTION

Figure 1A:
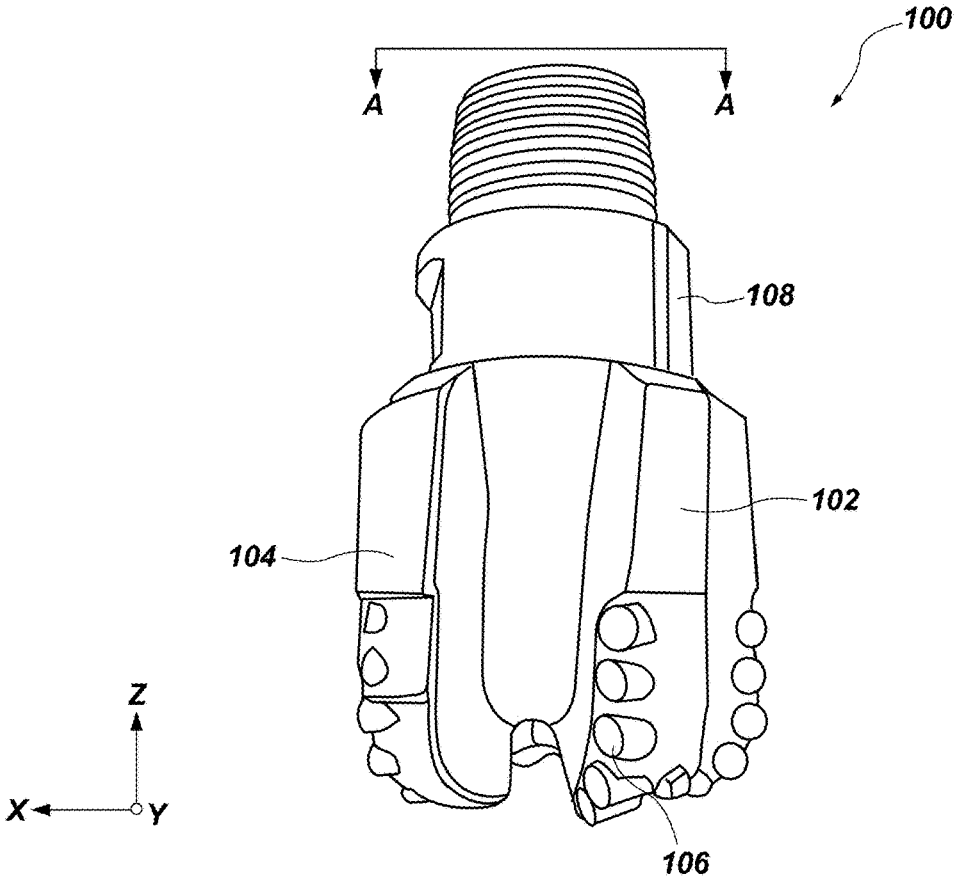
FIG. 1A illustrates a side view of an earth-boring drill bit in accordance with one embodiment.

The illustrations presented herein are not actual views of any drill bit or sensor module for a drill bit, or any component thereof, but are merely idealized representations, which are employed to describe embodiments of the invention.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any drill bit or sensor module for a drill bit when utilized in a conventional manner. Furthermore, these terms may refer to an orientation of elements of any drill bit or sensor module for a drill bit as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

Figure 1B:
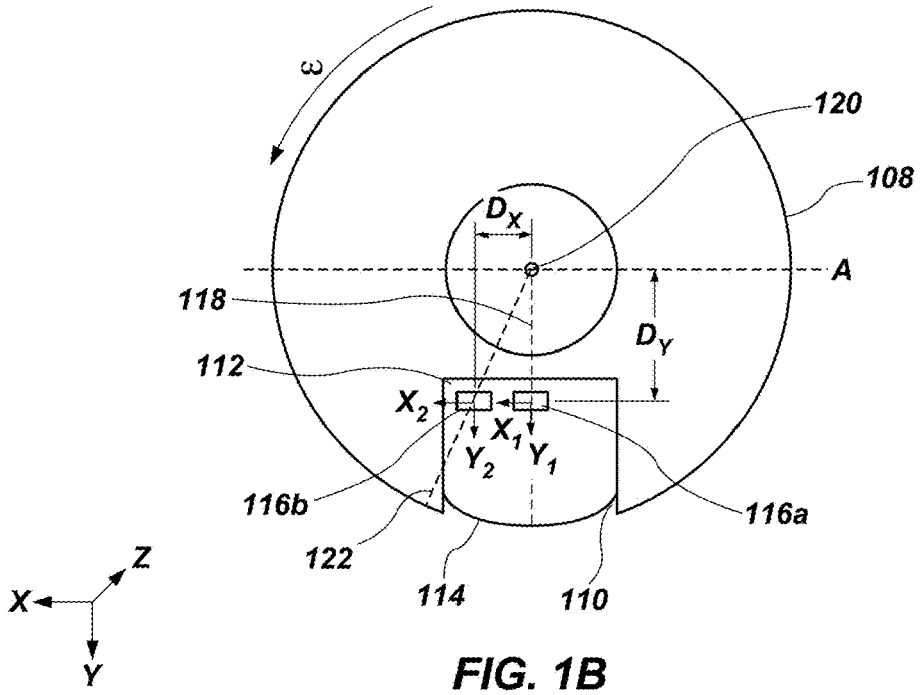
FIG. 1B is a cross-section view of the earth-boring drill bit taken along the line A-A in FIG. 1A showing a sensor module within the drill bit.

FIG. 1A illustrates a side view of an earth-boring drill bit in accordance with one embodiment, FIG. 1B is a cross-section view of the earth-boring drill bit taken along the line A-A in FIG. 1A. As shown in FIG. 1A, a drill bit 100 may comprise a drill bit body 102 having a plurality of blades 104. Each of the blades 104 may comprise a plurality of cutters 106. The drill bit 100 may be configured to be attached to the end of a drill string via a shank 108. The drill bit 100 may be used to drill subterranean formations.

As shown in FIG. 1B, the drill bit 100 may comprise an aperture 110. The aperture 110 may be formed on a side surface of the shank 108. The aperture 110 may house a sensor module 112 therein. A sensor module as used herein defines a housing or other structure on which a plurality of sensors are disposed. For example, a sensor module may comprise a plurality of sensors that are mounted onto or otherwise positioned on or within a housing or similar structure of the sensor module. Of course, the sensor module 112 may be positioned at other locations in the drill bit such as on a central rod housed in the center of the drill string or in the shank 108 of the drill bit 100. Thus, the positioning of the sensor module 112 shown in FIG. 1B is not intended to be limiting. It will thus be understood that obtaining or deriving information at a drill bit includes using information from a sensor module that may be positioned on the drill bit or on any other location of the drill string.

A cap 114 may be placed over the sensor module 112 and may close the aperture 110 to protect the sensor module 112 and components thereof. The sensor module 112 may comprise a variety of sensors that may provide information regarding the drill bit 100. Included among these sensors is a first accelerometer 116*a* and a second accelerometer 116*b*. The first and second accelerometers 116*a*, 116*b* may be any suitable accelerometers as now known or later developed. In this example, the first and second accelerometers 116*a*, 116*b* comprise two-axes accelerometers that are configured to detect accelerations along two measurement axes. For example, as shown in FIG. 1B, the first and second accelerometers 116*a*, 116*b* may measure acceleration in the x-direction and the y-direction. The x-direction and the y-direction may be perpendicular to one another and may both be perpendicular to a rotational center axis 120 of the drill bit 100, or the z-direction, as shown.

The first accelerometer 116*a* may be disposed on the sensor module 112 within the aperture 110 such that one of its measurement axes is parallel with a radius of the shank 108 of the drill bit 100. For example, the measurement axis $y_1$ of the first accelerometer 116*a* may align with a first radius 118 of the drill bit 100 that extends from a center axis 120 of the drill bit 100 to an outer side surface of the shank 108. The measurement axis $x_1$ of the first accelerometer 116*a* may be perpendicular to the axis $y_1$ (e.g., extends in the x-direction). Both of the measurement axes $y_1$ and $x_1$ may be perpendicular to the center axis 120 of the drill bit 100, or perpendicular to the z-direction.

The second accelerometer 116*b* may be disposed on the sensor module 112 within the aperture 110 such that it is offset from the first accelerometer 116*a* by a distance $D_x$ in the x-direction (e.g., in a direction aligned with the measurement axis $x_1$ of the first accelerometer 116*a*). The second accelerometer 116*b* is oriented such that its measurement axes $x_2$ and $y_2$ are parallel with the measurement axes $x_1$ and $y_1$ of the first accelerometer 116*a*. So positioned, the measurement axes $x_2$ and $y_2$ are neither aligned with or perpendicular to a radius of the shank 108, such as second radius 122.

With the first and second accelerometers 116*a*, 116*b* so positioned, acceleration data from the first and second accelerometers 116*a*, 116*b* may be used to determine the angular acceleration, the tangential acceleration, and the centripetal acceleration associated with the rotation of the drill bit 100. Furthermore, the data from the first and second accelerometers 116*a*, 116*b* may also be used to determine lateral or translational acceleration of the drill bit 100, e.g., acceleration of the drill bit 100 in the x-direction and/or the y-direction, such as those that may be caused by vibrations experienced during a drilling process.

Figure 1C:
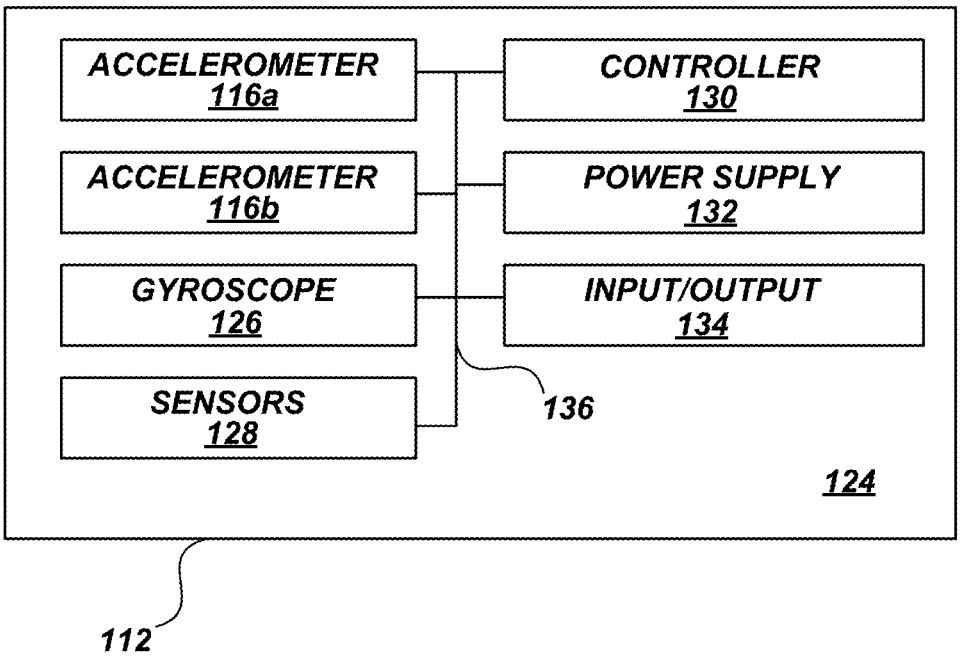
FIG. 1C is a schematic view of the sensor module shown in FIG. 1B.

A schematic view of the sensor module 112 is shown in FIG. 1C. The sensor module 112 may comprise a housing 124. The various components of the sensor module 112 may be mounted onto or within the housing 124. The housing 124 may be configured to be mounted within the aperture 110 of the shank 108 of the drill bit 100.

As mentioned above, the sensor module 112 comprises a first accelerometer 116*a* and a second accelerometer 116*b*. The sensor module 112 may also comprise at least one rotational motion sensor. A rotational motion sensor as defined herein may be a sensor that is configured to measure rotational movement at a drill bit such as a gyroscope, a magnetometer, a tachometer, an optical sensor, or other sensors or combinations of such sensors. In this embodiment, the rotational motion sensor may be a gyroscope 126. The gyroscope 126 may be configured to detect at least a rotational velocity of the drill bit 100. The sensor module 112 may also comprise other additional sensors 128 such as a magnetometer, a thermometer, or the like.

The sensor module 112 may comprise a controller 130. The controller 130 may comprise a processor and a memory, and may be configured to control the operation of the sensor module 112 including the various components of the sensor module 112. The controller 130 may also be configured to provide post-processing of data collected by the first accelerometer 116*a*, the second accelerometer 116*b*, the gyroscope 126, and the additional sensors 128. Such post processing may include deriving additional physical phenomena experienced at the drill bit 100 based on the received data.

The sensor module 112 may also comprise a power supply 132, such as a battery, to provide electrical power to the various components of the sensor module 112. The sensor module 112 may comprise one or more input/output devices 134. The input/output devices 134 may be configured to send and/or receive information from a device external to the sensor module 112. The input/output devices 134 may utilize any suitable wired or wireless protocol for sending and/or receiving information from the device external to the sensor module 112. A communications bus 136 may be provided in the sensor module 112 to communicatively and/or electrically connect the various components of the sensor module 112 to the controller 130 and the power supply 132.

The sensor module 112 may be configured to detect various physical phenomena at the drill bit 100 and may be configured to derive other physical phenomena at the drill bit 100 based on the detected phenomena. For example, as mentioned above, the sensor module 112 may measure acceleration with the first accelerometer 116*a* and the second accelerometer 116*b* including acceleration along each of the measurement axes $x_1$, $y_1$ and $x_2$, $y_2$. Based on the measured acceleration, the sensor module 112, or a device external to the sensor module 112, may derive angular, tangential, centripetal, and lateral acceleration at the drill bit 100.

During a drilling process, some of the data obtained by the sensor module 112 may be detected as being inaccurate or incomplete. For example, during some drilling operations, an acceleration experienced along one or both measurement axes of one or both of the first accelerometer 116*a* or the second accelerometer 116*b* may exceed a measurement limit or capacity of the first accelerometer 116*a* or the second accelerometer 116*b*.

For example, the first accelerometer 116*a* or the second accelerometer 116*b* may be configured to measure acceleration along each axis up to a value of 40 g (where g is gravitational force equivalent). When an acceleration experienced along one or both axes of the first accelerometer 116*a* or the second accelerometer 116*b* exceeds 40 g, the acceleration data returned by the first accelerometer 116*a* or the second accelerometer 116*b* is clipped at 40 g, even though the actual acceleration is higher than 40 g. This results in acceleration data from the first accelerometer 116*a* or the second accelerometer 116*b*, as well as post-processing values based on the acceleration data, being inaccurate.

In other examples, data from the sensor module 112 may be inaccurate, incomplete, or missing. For example, during a drilling operation, data from a gyroscope 126 may be inaccurate or missing due to temporary or permanent failure of the gyroscope 126. In each of the above situations, the robustness of the sensor module 112 is increased if the sensor module 112 is still able to accurately detect and/or derive the physical phenomena experienced at the drill bit 100 even when data from one or more of the sensors of the sensor module 112 is inaccurate.

Figure 2:
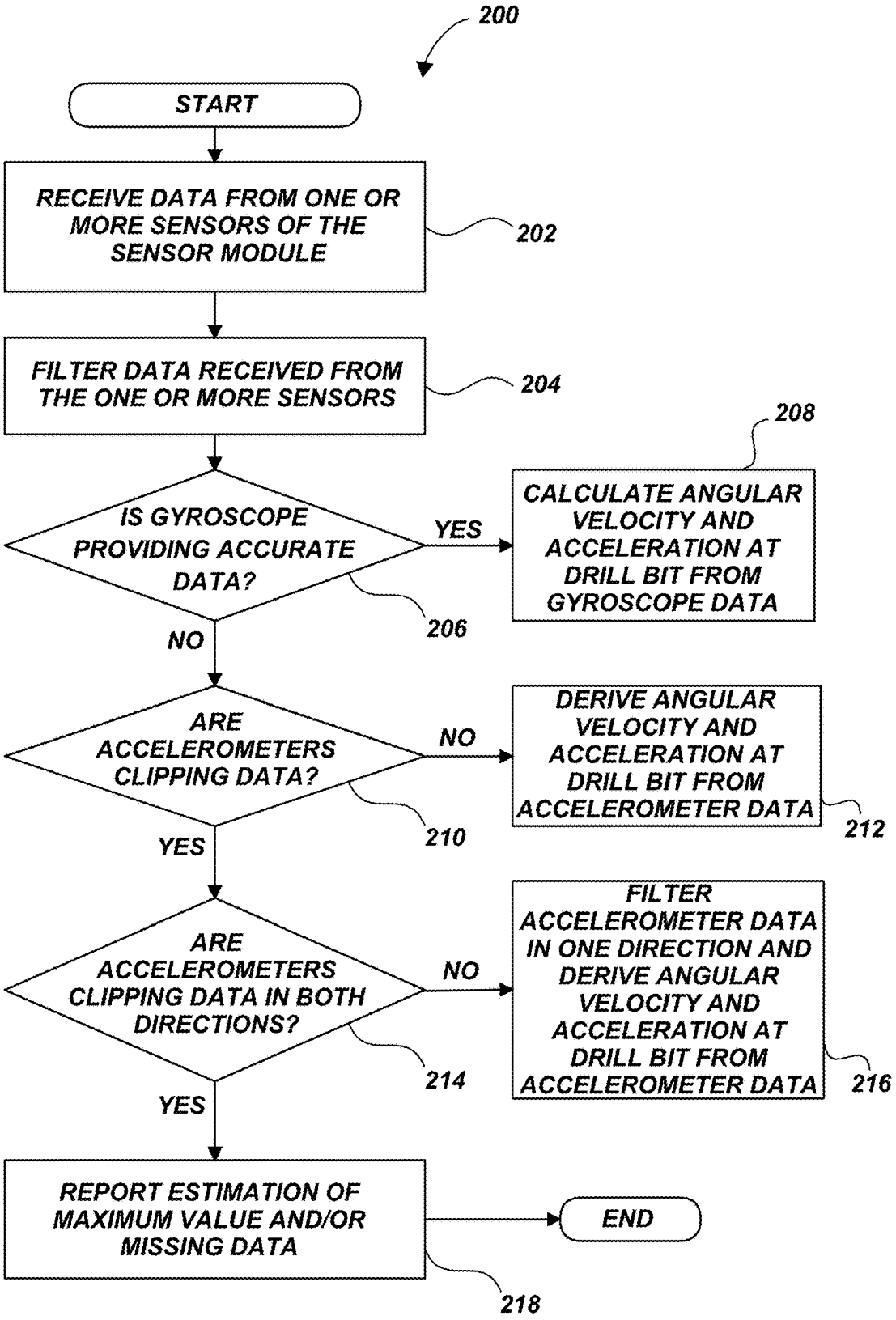
FIG. 2 illustrates a method of finding an angular acceleration and an angular velocity at a drill bit in accordance with one embodiment.

FIG. 2 shows a method 200 of detecting angular velocity and angular acceleration of a drill bit, such as drill bit 100. In step 202, data is received from one or more sensors of the sensor module. For example, the controller 130 of the sensor module 112 may receive data from the first accelerometer 116*a*, the second accelerometer 116*b*, the gyroscope 126, and additional sensors 128. In some embodiments, the controller 130 may be configured to send such data to a device external to the sensor module 112 via the input/output devices 134 of the sensor module 112.

In step 204, the data received may be processed through one or more filtering processes to smooth the data, to filter out noise from the data, or the like. For example, the data may be filtered using a Kalman filter to smooth the data and reduce noise in the data. In step 206, the data from a gyroscope, such as gyroscope 126, is evaluated to determine if the gyroscope is providing accurate data. For example, if data is missing, or if data is outside an expected range of data (such as returning both positive and negative rotational velocity during a drilling operation), it may be determined that the data from the gyroscope is inaccurate or missing. When the data is determined to be accurate data, the method 200 proceeds to step 208. In step 208, angular velocity may be measured from the data from the gyroscope, and angular acceleration may be derived from the angular velocity using the data from the gyroscope. For example, angular acceleration $\dot{\omega}$ may be found based on a change in angular velocity $\omega$ relative to a change in time t as shown by the following equation:

$$\dot{\omega} = \frac{\Delta\omega}{\Delta t}$$

The information from the gyroscope may also be used to calculate a tangential and centripetal acceleration of the drill bit at a desired radial location of the drill bit 100, such as location of the first accelerometer 116*a* and second accelerometer 116*b*. For example, the tangential acceleration $a_t$ may be derived for a radial position r of an accelerometer using the following equation:

$$a_t = r\dot{\omega}$$

The centripetal acceleration ac may be derived for a radial position r of an accelerometer using the following equation:

$$a_c = r\omega^2$$

Returning to step 206, when the data from the gyroscope is determined not to be accurate, the method 200 proceeds to step 210. In step 210, it is determined whether one or more of the accelerometers, such as first accelerometer 116*a* and/or second accelerometer 116*b*, are providing clipped data. If the data from the one or more accelerometers does not include clipped data, then the method proceeds to step 212.

In step 212, the data from the accelerometers, such as first accelerometer 116*a* and second accelerometer 116*b*, are used to derive the angular velocity and angular acceleration at the drill bit, such as drill bit 100. For example, the first accelerometer 116*a* may provide acceleration data in two measurement axes, such as acceleration data associated with measurement axes $x_1$ and $y_1$, while the second accelerometer 116*b* may provide acceleration data in two measurement axes, such acceleration data associated with measurement axes $x_2$ and $y_2$ (see FIG. 1B). Based on the acceleration data from measurement axes $x_1$ and $y_1$ from the first accelerometer 116*a* ($a_{x1}$ and $a_{y1}$, respectively) and measurement axes $x_2$ and $y_2$ from the second accelerometer 116*b* ($a_{x2}$ and $a_{y2}$, respectively), the angular velocity $\omega$ may be derived utilizing the following equation:

$$\omega = \sqrt{\frac{a_{x1} - a_{x2}}{D_x}}$$

Once the angular velocity $\omega$ is obtained from the accelerometer data, the angular acceleration $\dot{\omega}$, tangential acceleration at, and centripetal acceleration $a_c$ may be derived as explained above. The angular acceleration $\dot{\omega}$ may also be derived by the following equation:

$$\dot{\omega} = \frac{a_{y2} - a_{y1}}{D_x}$$

Returning to step 210, if it is determined that the accelerometers are clipping data, the method 200 proceeds to step 214. For example, if an accelerometer, such as first accelerometer 116*a* and or second accelerometer 116*b*, has a capacity limit of 40 g in each of its measurement axes, and the accelerometer is returning acceleration data of 40 g over a predetermined amount of time in one or more of its measurement axes, then it may be determined that the accelerometer is clipping data. In other words, it may be determined that the actual acceleration at the accelerometer exceeds the measurement capacity of the accelerometer along the measurement axis. When this determination is made, the method proceeds to step 214.

In step 214, it is determined whether the one or more accelerometers are clipping data in both of their measurement axes. If not, (e.g., if the accelerometer data along only one measurement axis is clipping data) the method 200 proceeds to step 216. In step 216, the accelerometer data may be filtered to remove or reduce the clipped data received from the accelerometers, such as the first accelerometer 116*a* and the second accelerometer 116*b*.

For example, based on the accelerations experienced at the first accelerometer 116*a* and the second accelerometer 116*b*, the data from each of the first accelerometer 116*a* and the second accelerometer 116*b* may be clipped only in the y-direction (e.g., $a_{y1}$ and $a_{y2}$) while data in the in x-direction (e.g., $a_{x1}$ and $a_{x2}$) are not clipped. In this example, the angular velocity ω may be obtained as outlined above based on $a_{x1}$ and $a_{x2}$. The angular acceleration ω may be derived from the angular velocity ω. In this example, the angular velocity ω and the angular acceleration ω are obtained without reference to the clipped data (e.g., $a_{y1}$ and $a_{y2}$ are removed and are not used to determine ω and $\dot{\omega}$.)

In another example, based on the accelerations experienced at the first accelerometer 116*a* and the second accelerometer 116*b*, the data from each of the first accelerometer 116*a* and the second accelerometer 116*b* may be clipped only in the x-direction (e.g., $a_{x1}$ and $a_{x2}$) while data in the y-direction (e.g., $a_{y1}$ and $a_{y2}$) are not clipped. In this Example, angular acceleration $\dot{\omega}$ may be obtained as outlined above based on $a_{y1}$ and $a_{y2}$. To obtain the angular velocity, the acceleration data from the accelerometers may be filtered. For example, the acceleration data may be modified by filtering a portion of the accelerometer data that is not attributed to a lateral acceleration to determine angular velocity. The acceleration measured in the y-direction at the first accelerometer 116*a* may be modeled as the combination of the lateral acceleration and the centripetal acceleration as follows:

$$a_{y1}=A_y-\omega^2 D_y$$

Based on this, the data received from the first accelerometer $a_{y1}$ may be filtered to remove data that corresponds to the lateral acceleration $A_y$. In this manner, the remaining data after filtering corresponds only to the centripetal acceleration which is based on the angular acceleration ω. With the lateral acceleration data removed from the measured acceleration in the y-direction of the first accelerometer 116*a*, the angular velocity ω may be obtained by solving the above equation for ω where $A_y$ is assumed to be zero and where $a_{y1f}$ is the filtered data from $a_{y1}$, as follows:

$$\omega = \sqrt{\frac{a_{y1f}}{D_y}}$$

In this manner, the angular velocity ω and the angular acceleration $\dot{\omega}$ may be obtained even when the rotational sensor (e.g., gyroscope 126) is not providing accurate information and when the accelerometers are clipping data alone one axial direction. Methods for filtering the accelerometer data to isolate the lateral acceleration and/or the centripetal acceleration are discussed in more detail below with reference to FIG. 4.

Returning to step 214, it may be determined that one or more of the accelerometers, such as the first accelerometer 116*a* and/or the second accelerometer 116*b*, may be clipping accelerometer data along both of their measurement axes, such as measurement axes $x_1$ and $y_1$ from the first accelerometer 116*a* and/or measurement axes $x_2$ and $y_2$ from the second accelerometer 116*b*. For example, if an accelerometer, such as first accelerometer 116*a* and or second accelerometer 116*b*, has a capacity limit of 40 g in both of its measurement axes, such as measurement axes $x_1$ and $y_1$ and/or measurement axes $x_2$ and $y_2$, and the accelerometer is returning acceleration data of 40 g over a predetermined amount of time in both of its measurement axes, then it may be determined that the accelerometer is clipping data along both of its measurement axes. When it is determined that an accelerometer is clipping data in both directions, the method 200 proceeds to step 218.

In step 218, an estimation of a maximum value of angular velocity and/or angular acceleration may be provided with a caveat that the estimate is based on missing and/or inaccurate data. The method 200 may then be repeated or terminated.

Figure 3:
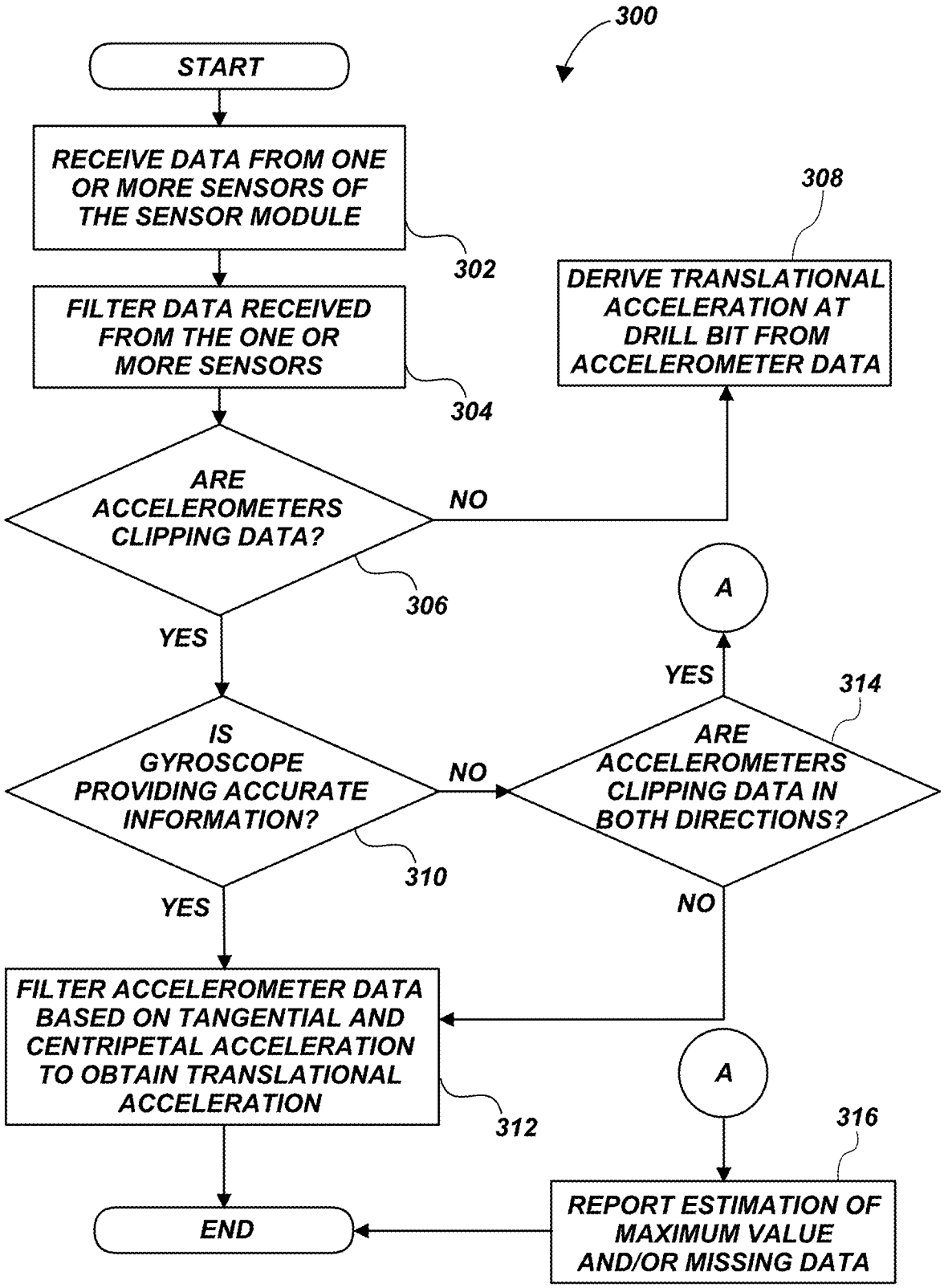
FIG. 3 illustrates a method of finding a translational acceleration at a drill bit in accordance with one embodiment.

FIG. 3 shows a method 300 of detecting lateral or translation acceleration at a drill bit, such as drill bit 100. In step 302, data is received from one or more sensors of the sensor module. For example, the controller 130 of the sensor module 112 may receive data from the first accelerometer 116*a*, the second accelerometer 116*b*, the gyroscope 126, and additional sensors 128, or such data may be received at a device external to the sensor module 112 via the input/output devices 134 of the sensor module 112.

In step 304, the data received may be processed through one or more filtering processes to smooth the data, to filter out noise from the data, or the like. For example, the data may be filtered using a Kalman filter to smooth the data and reduce noise in the data. In step 306, it is determined whether the accelerometers, such as the first accelerometer 116*a* and/or the second accelerometer 116*b*, are clipping data. If not, the method 300 proceeds to step 308.

In step 308, lateral or translational acceleration at the drill bit, such as drill bit 100, are derived from the accelerometer data received from the accelerometers. For example, the acceleration data detected from measurement axes $x_1$ and $y_1$ of the first accelerometer 116*a* and the acceleration data detected from measurement axes $x_2$ and $y_2$ from the second accelerometer 116*b* may be used to derive a first translational or lateral acceleration $A_x$ in a first direction (e.g., x-direction shown in FIG. 1B) and a second translation or lateral acceleration $A_y$ in a second direction (e.g., y-direction shown in FIG. 1B). For example, the following equations may be used to determine $A_x$ and $A_y$:

$$A_x = a_{x1} + (a_{y2} - a_{y1})\frac{D_y}{D_x}$$

$$A_y = a_{y1} + (a_{x1} - a_{x2})\frac{D_y}{D_x}$$

Returning to step 306, it may be determined that the accelerometers are clipping data. For example, if an accelerometer, such as first accelerometer 116*a* and or second accelerometer 116*b*, has a capacity limit of 40 g in both of its measurement axes, and the accelerometer is returning acceleration data of 40 g over a predetermined amount of time in one or more of its measurement axes, then it may be determined that the accelerometer is clipping data. If it is determined that an accelerometer is returning clipped data, the method 300 may proceed to step 310.

In step 310, it may be determined whether the gyroscope is providing accurate information. If the gyroscope is providing accurate information, then the method proceeds to step 312. In step 312, the accelerometer data is filtered to remove the clipped data based on the tangential acceleration at and centripetal acceleration $a_c$ in order to obtain the translational acceleration in each of the direction (e.g., $A_x$ and $A_y$). For example, the acceleration measured at the first accelerometer 116*a*, $a_{x1}$ and $a_{y1}$, may include both centripetal acceleration $a_c$, tangential acceleration $a_t$ and lateral acceleration, $A_x$ and $A_y$, as shown in the following equations:

$$a_{x1}=A_x-\dot{\omega}D_y$$

$$a_{y1}=A_y-\omega^2D_y$$

The acceleration measured at the second accelerometer 116*b*, $a_{x2}$ and $a_{y2}$, may include both centripetal acceleration $a_c$, tangential acceleration $a_t$ and lateral acceleration, $A_x$ and $A_y$, as shown in the following equations:

$$a_{x2}=A_x-\dot{\omega}D_y-w^2D_x$$

$$a_{y2}=A_y+\dot{\omega}D_x-w^2D_y$$

Based on this, the accelerometer data may be filtered to remove the components dependent on the angular velocity and the angular acceleration. Given that the angular velocity is obtained from the rotational motion sensor (e.g., gyroscope 126) as outlined above, the filtering of the accelerometer data may be based on the measured angular velocity $\omega$ and angular acceleration $\dot{\omega}$. Assuming that the filtered data does not include any components based on the angular velocity $\omega$ and angular acceleration $\dot{\omega}$, the filtered data, $a_{x1f}$, $a_{x2f}$, and $a_{y1f}$, $a_{y2f}$, should be equal to the lateral acceleration $A_x$ and $A_y$, respectively, as shown in the following equations:

$$a_{x1f}=A_x$$

$$a_{y1f}=A_y$$

$$a_{x2f}=A_x$$

$$a_{y2f}=A_y$$

In this manner, the lateral acceleration in each direction, $A_x$, $A_y$, may be determined even if one or more accelerometers are clipping data along one or both measurement axes. Methods of filtering accelerometer data will be discussed in more detail below with reference to FIG. 4.

Returning to step 310, if the gyroscope is not providing accurate information, the method may proceed to step 314. In step 314, it may be determined whether one or more of the accelerometers are clipping data along both of their measurement axes. If not, (e.g., if the accelerometer data along only one measurement axis is clipping data) then the method 300 proceeds to step 312. In step 312, the data from the accelerometers along the measurement axis that is not clipped may be used to determine angular velocity and angular acceleration, as discussed above with reference to FIG. 2. Once the angular acceleration and angular velocity are determined, the lateral acceleration in each direction, $A_x$, $A_y$, may be obtained as explained above.

Returning to step 314, it may be determined that one or more accelerometers are clipping data along both measurement axes. For example, if an accelerometer, such as first accelerometer 116*a* and or second accelerometer 116*b*, has a capacity limit of 40 g in both of its measurement axes, such as measurement axes $x_1$ and $y_1$ and/or measurement axes $x_2$ and $y_2$, and the accelerometer is returning acceleration data of 40 g over a predetermined amount of time in both of its measurement axes, then it may be determined that the accelerometer is clipping data along both of its measurement axes. When it is determined that an accelerometer is clipping data in both directions, the method 300 proceeds to step 316.

In step 316, an estimation of a maximum value of translational or lateral acceleration may be provided with a caveat that the estimate is based on missing and/or inaccurate data. The method 300 may then be repeated or terminated.

Figure 4:
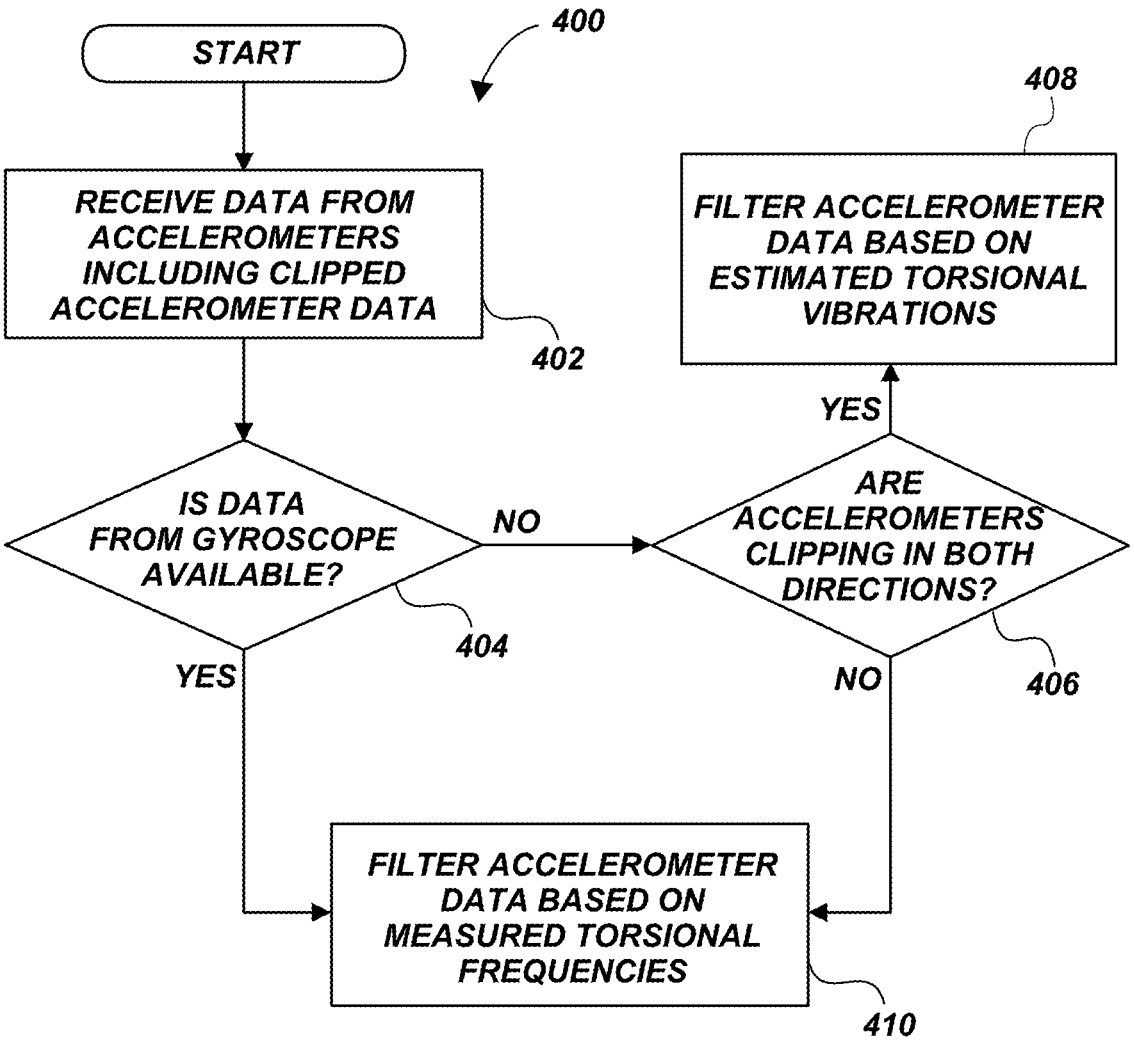
FIG. 4 illustrates a method of filtering acceleration data obtained at a drill bit in accordance with one embodiment.

FIG. 4 shows a method 400 of filtering clipped accelerometer data at a drill bit. As mentioned above, when accelerometer data from one or more accelerometers is clipped, such as due to an acceleration along one of the measurement axes of the accelerometer exceeding a maximum measurement capacity of the accelerometer, the data may be filtered to remove or substantially remove the clipped data. With the clipped data filtered and removed, the remaining accelerometer data may be used to determine physical phenomena detected at the drill bit, such as drill bit 100. In step 402 of the method 400, data from the accelerometers, such as the first accelerometer 116*a* and the second accelerometer 116*b*, may be received, which accelerometer data includes clipped accelerometer data.

In step 404, it is determined whether accurate gyroscope data is available, such as from gyroscope 126. If no accurate gyroscope data is available, the method 400 proceeds to step 406. In step 406, it is determined whether the accelerometers are clipping data along both measurement axes. If it is determined that the accelerometer data includes clipped data along both measurement axes, then the method 400 proceeds to step 408. In step 408, the clipped data from the accelerometer may be filtered based on estimated frequencies of torsional vibrations within the drill bit 100. For example, based on domain knowledge from historical data in similar drilling operations, acceleration readings at particular frequencies known to be associated with torsional vibrations in the drill bit may be filtered from the acceleration data, thereby removing the clipped acceleration data. In one example, acceleration data with frequencies below 5 Hz and above 100 Hz may be filtered based on domain knowledge from historical data. Such filtering may be accomplished via known data processing methods including using one or more of a low-pass filter, a high-pass filter, a band-pass filter, a band-stop filter, or the like. Once the acceleration data is filtered, the acceleration data may be used to determine angular acceleration, tangential acceleration, centripetal acceleration, and lateral or translational acceleration as described above with reference to FIG. 2 and FIG. 3.

Returning to step 404 and step 406, if accurate gyroscope data is available, or if the accelerometers are clipping data long only one measurement axis, the method 400 proceeds to step 410. In step 410, data received from the gyroscope may be used to measure angular velocity $\omega$ and angular acceleration $\dot{\omega}$. The angular velocity $\omega$ and angular acceleration $\dot{\omega}$ may be associated with frequencies of torsional vibrations, and the acceleration data may be filtered based on the measured frequencies. Such filtering may be accomplished via known data processing methods including using one or more of a low-pass filter, a high-pass filter, a band-pass filter, a band-stop filter, or the like. For example, angular velocity detected by the gyroscope may be used to identify the excited torsional frequencies in a drilling operation, which may likely be the cause of the clipped data received from the accelerometers (e.g., the first accelerometer 116*a* and second accelerometer 116*b*). Based on the identified torsional frequencies, a band-stop filter may be applied to the accelerometer signal received from the accelerometers to remove the clipped accelerometer data. For example, if torsional frequencies are identified at 140 Hz, a band-stop filter may be applied to the acceleration signal to remove acceleration data obtained at a range centered on 140 Hz. Once the accelerometer data is filtered, the filtered data may be used determine angular acceleration, tangential acceleration, centripetal acceleration, and lateral acceleration as described above with reference to FIG. 2 and FIG. 3.

Similarly, data received from the accelerometers (e.g., the first accelerometer 116*a* and the second accelerometer 116*b*) along a measurement axis that is not returning clipped acceleration data may be used to identify frequencies of torsional vibrations associated with excited torsional frequencies in a drilling operation that correspond to centripetal acceleration and tangential acceleration of the drill bit. The acceleration data may then be filtered to isolate the lateral acceleration or the tangential and centripetal acceleration of the drill bit based on the identified frequencies. Such filtering may be accomplished via known data processing methods including using one or more of a low-pass filter, a high-pass filter, a band-pass filter, a band-stop filter, or the like. For example, if identified torsional frequencies from the acceleration data are identified at 140 Hz, a band-stop filter may be applied to the acceleration signal to remove acceleration data obtained at a range centered on 140 Hz. This may isolate the lateral acceleration and may filter out the clipped data. Alternatively, a band-pass filter may be applied to the acceleration signal to isolate the centripetal and/or tangential acceleration from the acceleration data. Once the accelerometer data is filtered, the filtered data may be used determine angular acceleration, tangential acceleration, centripetal acceleration, and lateral acceleration as described above with reference to FIG. 2 and FIG. 3.

Variations to the above methods are also within the scope of the disclosure. For example, instead of determining whether accurate gyroscope data is available as set forth in step 404, the method of filtering clipped accelerometer data may include steps 402 and 406 without reference to any gyroscope information. In some embodiments, other sensors may be used to obtain angular velocity and angular acceleration instead of or in addition to the gyroscope, such as a magnetometer.

Based on the above, a sensor module for a drill bit may provide robust performance even when data from one or more sensors of the sensor module is missing or inaccurate. Accordingly, data from the sensor module may be accurate even when a drill bit operates in harsh conditions, and even when physical phenomena at a drill bit are outside a capacity of one or more of the sensors of the drill bit.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A method of deriving angular acceleration of a drill bit, the method comprising:

receiving data from one or more sensors of a sensor module installed on a drill bit, the one or more sensors comprising at least one accelerometer and at least one rotational motion sensor;

filtering the data received from the one or more sensors; and calculating angular velocity and angular acceleration at the drill bit from acceleration data received from the at least one accelerometer in response to a determination that the at least one rotational motion sensor is missing data or is providing data outside of a predetermined range.

2. The method of claim 1, wherein the at least one rotational motion sensor comprises a gyroscope, and wherein the method further comprises calculating angular velocity and angular acceleration at the drill bit from gyroscope data received from the gyroscope in response to a determination that the gyroscope is providing accurate data.

3. The method of claim 1, further comprising:

determining that the acceleration data is providing clipped acceleration data along one measurement axis of the at least one accelerometer; and filtering the acceleration data to remove clipped data prior to calculating the angular velocity and the angular acceleration at the drill bit from data received from the at least one accelerometer.

4. The method of claim 3, wherein filtering the accelerometer data to remove the clipped data comprises filtering the accelerometer data based on frequencies of estimated torsional vibrations at the drill bit during a drilling process.

5. The method of claim 3, wherein filtering the accelerometer data to remove the clipped data comprises applying one or more of a band-pass filter, a band-stop filter, a high-pass filter, or a low-pass filter.

6. The method of claim 1, further comprising:

positioning the one or more sensors on the sensor module; and positioning the sensor module in an aperture disposed on a side surface a shank of the drill bit.

7. The method of claim 6, wherein the at least one accelerometer comprises a first accelerometer and a second accelerometer, each of the first and second accelerometers comprising a first measurement axis and a second measurement axis perpendicular to the first measurement axis, and wherein the method further comprises:

positioning and orienting the first accelerometer within the aperture such that the first measurement axis of the first accelerometer is aligned with a radius of the drill bit; and positioning the second accelerometer within the aperture at a position offset from the first accelerometer in a direction aligned with the second measurement axis of the first accelerometer, and orienting the second accelerometer such that the first and second measurement axes of the second accelerometer are parallel with the first and second measurement axes of the first accelerometer.

8. A method of deriving translational acceleration of a drill bit, the method comprising:

receiving data from one or more sensors of a sensor module installed on a drill bit, the one or more sensors comprising at least one accelerometer and at least one rotational motion sensor;

filtering the data received from the one or more sensors, deriving translational acceleration at the drill bit from accelerometer data from the at least one accelerometer;

determining that the accelerometer data from the at least one accelerometer includes clipped data where a magnitude of an acceleration is greater than a measurement capacity of the at least one accelerometer; and filtering the accelerometer data to remove the clipped data when it is determined the accelerometer data from the at least one accelerometer includes the clipped data.

9. The method of claim 8, wherein filtering the accelerometer data to remove the clipped data comprises filtering the accelerometer data based on estimated frequencies of torsional vibrations at the drill bit based on historical data.

10. The method of claim 8, wherein the at least one rotational motion sensor comprises a gyroscope, and wherein the method further comprises:

measuring frequencies of torsional vibrations at the drill bit based on gyroscope data from the gyroscope, wherein filtering the accelerometer data to remove the clipped data comprises filtering the accelerometer data based on the measured frequencies of the torsional vibrations.

11. The method of claim 10, wherein filtering the accelerometer data to remove the clipped data comprises applying a band-stop filter centered around the measured frequencies of the torsional vibrations.

12. The method of claim 8, further comprising:

positioning the one or more sensors on the sensor module; and positioning the sensor module in an aperture disposed on a side surface a shank of the drill bit.

13. The method of claim 12, wherein the at least one accelerometer comprises a first accelerometer and a second accelerometer, each of the first and second accelerometers comprising a first measurement axis and a second measurement axis perpendicular to the first measurement axis, and wherein the method further comprises:

positioning and orienting the first accelerometer within the aperture such that the first measurement axis of the first accelerometer is aligned with a radius of the drill bit; and positioning the second accelerometer within the aperture at a position offset from the first accelerometer in a direction aligned with the second measurement axis of the first accelerometer, and orienting the second accelerometer such that the first and second measurement axes of the second accelerometer are parallel with the first and second measurement axes of the first accelerometer.

14. A method for deriving translational acceleration of a drill bit from at least one accelerometer installed on the drill bit, the method comprising:

receiving accelerometer data from the at least one accelerometer;

determining the accelerometer data comprises clipped data indicating that an acceleration along a measurement axis of the at least one accelerometer exceeds a measurement capacity of the at least one accelerometer;

filtering the clipped data from the accelerometer data based on frequencies of torsional vibrations of the drill bit; and determining translation acceleration based on the filtered accelerometer data.

15. The method of claim 14, wherein the frequencies of torsional vibration are based on historical torsional vibrations.

16. The method of claim 14, further comprising:

receiving gyroscope data from a gyroscope; and measuring the frequencies of the torsional vibrations of the drill bit based on the gyroscope data.

17. The method of claim 16, further comprising:

positioning the at least one accelerometer and the gyroscope on a sensor module; and positioning the sensor module in an aperture disposed on a side surface a shank of the drill bit.

18. The method of claim 17, wherein the at least one accelerometer comprises a first accelerometer and a second accelerometer, each of the first and second accelerometers comprising a first measurement axis and a second measurement axis perpendicular to the first measurement axis, and wherein the method further comprises:

positioning and orienting the first accelerometer within the aperture such that the first measurement axis of the first accelerometer is aligned with a radius of the drill bit; and positioning the second accelerometer within the aperture at a position offset from the first accelerometer in a direction aligned with the second measurement axis of the first accelerometer, and orienting the second accelerometer such that the first and second measurement axes of the second accelerometer are parallel with the first and second measurement axes of the first accelerometer.

19. The method of claim 14, further comprising:

positioning the at least one accelerometer on a sensor module; and positioning the sensor module in an aperture disposed on a side surface a shank of the drill bit.

20. The method of claim 19, wherein the at least one accelerometer comprises a first accelerometer and a second accelerometer, each of the first and second accelerometers comprising a first measurement axis and a second measurement axis perpendicular to the first measurement axis, and wherein the method further comprises:

positioning and orienting the first accelerometer within the aperture such that the first measurement axis of the first accelerometer is aligned with a radius of the drill bit; and positioning the second accelerometer within the aperture at a position offset from the first accelerometer in a direction aligned with the second measurement axis of the first accelerometer, and orienting the second accelerometer such that the first and second measurement axes of the second accelerometer are parallel with the first and second measurement axes of the first accelerometer.

* * * * *